US006260383B1

(12) United States Patent
Warren et al.

(10) Patent No.: US 6,260,383 B1
(45) Date of Patent: Jul. 17, 2001

(54) RING

(75) Inventors: Malcolm Warren, Corfu; David C. D. Reichert, Arkon, both of NY (US)

(73) Assignee: Warren Metallurgical, Inc., Corfu, NY (US)

( * ) Notice: Subject to any disclaimer, the term of this patent is extended or adjusted under 35 U.S.C. 154(b) by 0 days.

(21) Appl. No.: 09/342,170

(22) Filed: Jun. 28, 1999

(51) Int. Cl.[7] ..... A44C 19/00

(52) U.S. Cl. ..... 63/15; 63/3; D11/4; D11/26; D11/29; D11/37

(58) Field of Search ..... 63/3, 15; D11/4, D11/26, 29, 37, 38, 39

(56) References Cited

U.S. PATENT DOCUMENTS

| | | | | |
|---|---|---|---|---|
| D. 77,688 | * | 2/1929 | Goldstein et al. | D11/38 |
| D. 89,031 | * | 1/1933 | Ball et al. | D11/37 |
| D. 186,822 | * | 12/1959 | Goodman | D11/39 |
| D. 389,423 | * | 1/1998 | Wein | D11/37 |
| D. 390,150 | * | 2/1998 | Wein | D11/37 |
| D. 418,078 | * | 12/1999 | Pasquetti | D11/30 |
| 2,168,490 | * | 8/1939 | Moss | 63/15 |
| 2,653,402 | * | 9/1953 | Bonagura | 40/662 |
| 5,586,390 | * | 12/1996 | Barr | 29/896.411 |
| 6,062,045 | * | 5/2000 | West | 63/15 |

* cited by examiner

*Primary Examiner*—Anthony Knight
*Assistant Examiner*—Andrea Chop
(74) *Attorney, Agent, or Firm*—Greenwald & Basch LLP; Howard J. Greenwald

(57) ABSTRACT

An integral ring which is contains at least 35 weight percent of a precious metal selected from the group consisting of silver and gold and has a porosity of less than 0.1 percent, a Vickers pyramidal hardness of at least about 120, and a tensile strength at least about 60,000 pounds per square inch. The ring has an inner diameter of from about 0.55 to about 0.93 inches, and outer diameter of from about 0.61 to about 1.09 inches, a thickness of from about 0.03 to about 0.08 inches, and a circumference of from about 1.7 to about 3.5 inches. Disposed about and extending around the entire outer surface of the ring is a first annular groove and a second, spaced apart annular groove, and at least 10 adjoining recessed areas are disposed between and communicate with these annular grooves. Each of the first annular groove and the second annular groove has a width of from about 0.01 to about 0.02 inches and a depth of from about 0.008 to about 0.018 inches. Disposed between the adjoining recessed areas are at least about 10 raised indicia.

7 Claims, 14 Drawing Sheets

RING

MICROFICHE APPENDIX

This application contains a microfiche appendix consisting of one microfiche having Appendices A through D thereon, which together comprise a total of 19 frames of G-code programs.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

A process for the computer controlled machining of a ring in which blanks are cut from a tube of metal (such as silver or gold), two annular V grooves are machined into the blanks, and a multiplicity of recessed shapes are then machined into the space between the annular grooves.

BACKGROUND OF THE INVENTION

Jewelry rings have traditionally been made by an "investment casting" process, such as, e.g., the process described in U.S. Pat. Nos. 5,136,858, 4,744,274, 4,626,145, 3,991,809, 3,735,800, and the like. In this process, a master ring is made by hand and thereafter encased in raw rubber, which is then heated and pressure cured to form a solid rubber block. The cured rubber block is then cut open, the master ring is removed, and the cavity within the rubber block is then filled with molten wax. After cooling, the wax ring thus formed is then removed from the rubber block and encased in "investment" (which is primarily "plaster of Paris). The investment is then heated to remove the wax encased therein and cooled to the desired casting temperature. Molten metal is then poured into the investment, the investment is allowed to cool, and then the investment is broken up (usually with a waterjet) to remove the cast ring.

In one embodiment of this process, a strip of silver with Roman numerals stamped into it is wrapped around the cast ring and inlayed into a groove around the outside of the ring. One example of the ring made via this embodiment is a Roman numeral ring, which is sold by Tiffany and Company and has met with a substantial amount of commercial success.

The process of making the Roman numeral ring, described above, is tedious and cumbersome. Furthermore, the ring made by the process often contains a substantial number of pits and has one or more surfaces which are not suitably smooth. At least one of these defects is due to the presence of "shrinkage porosity" within the cast ring.

During the investment casting process, when the metal in the investment changes for a liquid to a solid, it shrinks by about ten percent. This reduction in volume causes small voids in the cast product; and, after the cast ring is given a high polish by conventional means, this "shrinkage porosity" manifests itself as small pits in the highly polished ring surfaces.

It is an object of this invention to provide a process for preparing a silver ring with no "shrinkage porosity" and the appearance defects associated therewith.

It is another object of this invention to provide a process for preparing a silver ring with smooth surfaces.

It is yet another object of this invention to provide a process for preparing a Roman numeral silver ring with high definition recesses disposed on the top surface of the ring.

SUMMARY OF THE INVENTION

In accordance with this invention, there is provided an integral ring which is comprised of at least 35 weight percent of a precious metal selected from the group consisting of silver and gold, wherein said ring has a porosity of less than 0.1 percent, a Vickers pyramidal hardness of at least about 120, and a tensile strength at least about 60,000 pounds per square inch. The ring has an inner surface, and outer surface, an inner diameter of from about 0.55 to about 0.93 inches, and outer diameter of from about 0.61 to about 1.09 inches, and a thickness of from about 0.03 to about 0.08 inches; it has a circumference of from about 1.7 to about 3.5 inches; disposed about and extending around the entire outer surface of the ring is a first annular groove and a second, spaced apart annular groove, and at least 10 adjoining recessed areas disposed between and communicating with these annular grooves, wherein each of the first annular groove and the second annular groove has a width of from about 0.01 to about 0.02 inches and a depth of from about 0.008 to about 0.018 inches; and disposed between the adjoining recessed areas are at least about 10 raised indicia.

BRIEF DESCRIPTION OF THE DRAWINGS

The invention will be described by reference to the following drawings, in which like numeral refer to like elements, and in which.

DESCRIPTION OF THE PREFERRED EMBODIMENTS

Figure 1:
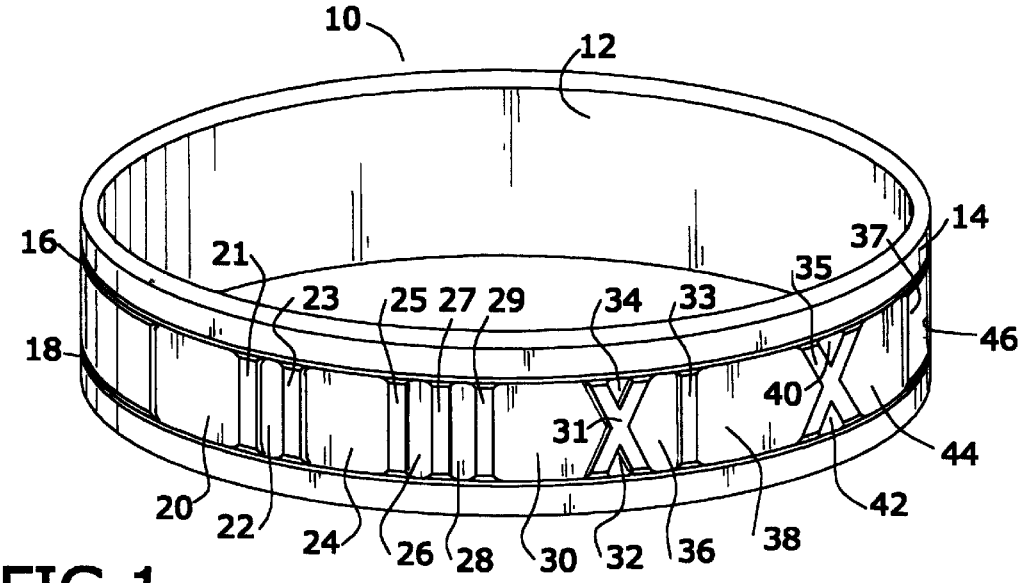
FIG. 1 is a perspective view of one preferred ring of this invention.

The claimed invention will first be described by reference to one preferred ring made by the process of the invention; and, thereafter, the process for making such ring will be described in detail.

A Preferred Ring Made by the Process of the Invention

In this section of the specification, a preferred "Roman numeral ring" which can be made by the process of this invention will be described.

The preferred roman numeral ring has a porosity of less than 0.1 percent. As used herein, the term "porosity" refers to the fraction as a percent of the total volume of a material occupied by channels or spaces within a material; see, e.g., page 1467 of the "McGraw-Hill Dictionary of Scientific and Technical Terms," Fourth Edition, edited by Sybil B. Parker (McGraw-Hill Book Company, New York, 1989).

The adverse affects of porosity upon fine jewelry are discussed in U.S. Pat. No. 5,558,833 of Marek R. Zamojski, the entire disclosure of which is hereby incorporated by reference into this specification. The patentee discloses that, with fine jewelry, ". . . it is important that the article . . . has a non-porous finish that is suitable for polishing;" and he discloses a particular silver alloy with a reduced porosity surface. He also makes reference to prior art patents disclosing similar low porosity alloy materials, including U.S. Pat. Nos. 2,157,933, 2,161,253, 4,030,918, 4,170,471, 4,409,181, 4,883,745, 4,948,557, 4,980,243, 4,992,297, and 5,021,214; the disclosure of each of these patents is also hereby incorporated by reference into this specification.

As is known to those skilled in the art, one means of determining the porosity of a ring is by the well-known Archimedes method; see, e.g., U.S. Pat. Nos. 5,183,785 and 4,642,231, the disclosures of which are hereby incorporated by reference into this specification.

The numeral ring of this invention has a hardness which is substantially greater than the hardness of prior art silver or silver-alloy rings, generally being about twice as hard and, thus, substantially less likely to deform. The prior art discloses various means for producing jewelry articles with improved hardness. See, e.g., U.S. Pat. No. 5,578,383 (article made from gold alloy with improved hardness and resistance to wear), U.S. Pat. No. 5,340,529 (gold jewelry alloy provides extended wear life and polish life), U.S. Pat. No. 5,180,551 (improved hardness increases resistance to abrasion), and the like. The entire disclosure of each of these United States patents is hereby incrporated by reference into this specification.

As used in this specification, the term hardness refers to hardness determined by the Vickers diamond pyramid hardness tester. This test method, and the apparatus it uses, are well known to those skilled in the art. See, e.g., U.S. Pat. No. 5,204,294 (pyramidal diamond hardness tester), U.S. Pat. No. 5,185,215 (pyramidal diamond hardness indenter), U.S. Pat. Nos. 5,173,331, 5,045,402, and the like. The disclosure of each of these United States patents is hereby incorporated by reference into this specification. Reference may also be had to a text by E. C. Rollason entitled "Metallurgy for Engineers," Fourth Edition (The Chaucer Press, Ltd., Bungay, Suffolk, 1982), at pages 2–5.

It is preferred that the ring of this invention have a Vickers pyramidal hardness at least about 120 and, more preferably, at least about 130. In one preferred embodiment, the Vickers hardness of the ring is at least about 160.

The preferred roman numeral ring has a tensile strength of at least about 60,000 pounds per square inch, and preferably a tensile strength of at least about 75,000 pounds per square inch. As used herein, tensile strength refers to the maximum tensile stress which a material is capable of sustaining and is generally calculated from the maximum load from a tension test carried to rupture and the original cross-sectional area of the specimen; see A.S.T.M. E-6 and A.S.T.M. E-28. Means for determining the tensile strength of a ring are well known and are described, e.g., on pages 5–15 of the aforementioned Rollason text.

In one embodiment, the preferred ring comprises a precious metal selected from the group consisting of silver, gold, and mixtures thereof. Where the precious metal is silver, at least 80 weight percent of the ring is comprised of silver. In this embodiment, the ring may consist essentially of silver. When the precious metal is gold, at least about 37 percent of the ring is comprised of gold, but the ring may consist essentially of gold.

The ring may comprise a silver alloy, in which case at least about 80 weight percent of the ring is silver. The remainder of the ring may comprise copper at a concentration of from about 0.1 to about 20 weight percent and, preferably, at a concentration of from about 5 to about 10 weight percent. Alternatively, or additionally, the reminder of the ring may comprise zinc at a concentration of from about 0.1 to about 10 weight percent and, preferably, from about 5 to about 10 weight percent. Alternatively, or additionally, the remainder of the ring may comprise indium at a concentration of from about 0.1 to about 5 weight percent.

Silver alloys for use in jewelry fabrication are well known to those skilled in the art and are described, e.g., in U.S. Pat. Nos. 5,822,441, 5,817,195, 5,330,713, 5,037,708, 5,019,335, 4,948,557, and the like. The disclosure of each of these United States patents is hereby incorporated by reference into this specification.

The ring may comprise a gold alloy, in which case at least about 37 weight percent of the ring is gold. The remainder of the ring may comprise copper at a concentration of from about 0.1 to about 30 weight percent. Alternatively, or additionally, the reminder of the ring may comprise silver at a concentration of from about 0.1 to about 40 weight percent and, preferably, from about 5 to about 15 weight percent. Alternatively, or additionally, the remainder of the ring may comprise zinc at a concentration of from about 0.1 to about 25 weight percent. Alternatively, or additionally, the remainder of the ring may comprise nickel at a concentration of from about 5 to about 30 weight percent. Alternatively, or additionally, the remainder may trace amounts of cobalt (from about 0.1 to about 0.5 weight percent), iridium (from about 0.01 to about 0.1 weight percent), and the like.

Gold alloys for use in jewelry fabrication are well known to those skilled in the art and are described, e.g., in U.S. Pat. Nos. 5,409,663, 5,384,089, 5,372,779, 5,340,529, 5,180,551, 5,173,132, 5,164,026, 5,059,255, 4,865,809, 4,557,895, 4,446,102, 4,396,578, and the like. The disclosure of each of these patents is hereby incorporated by reference into this specification.

In one preferred embodiment, the gold alloy material used in the ring is comprised of at least about 58 weight percent of gold, at least about 8 percent of silver, at least about 20 weight percent of copper, and at least about 12 weight percent of zinc; and is commonly referred to as "14 carat yellow gold."

FIG. 1 is a perspective view of one preferred ring 10 which preferably is integral, i.e., is machined from one piece of silver or gold stock. Referring to FIG. 1, it will be seen that ring 10 is comprised of an inner surface 12, an outer surface 14, a first annular groove 16 disposed on outer surface 14, and second annular groove 18 disposed on outer surface 14, and a multiplicity of recessed shapes 20, 22, 24, 26, 28, 30, 32, 34, 36, 38, 40, 42, 44, 46, et seq. disposed between annular grooves 16 and 18 and around the some or all of the outer surface 14 of the ring 10.

In the embodiment depicted in FIG. 1, the recessed shapes 20 et seq. are machined away areas which, after machining, leaved raised indicia 21, 23, 25, 27, 29, 31, 33, 35, 37, 39, 41, 43, 47 et seq. (see FIG. 1; also see FIG. 3).

Figure 2:
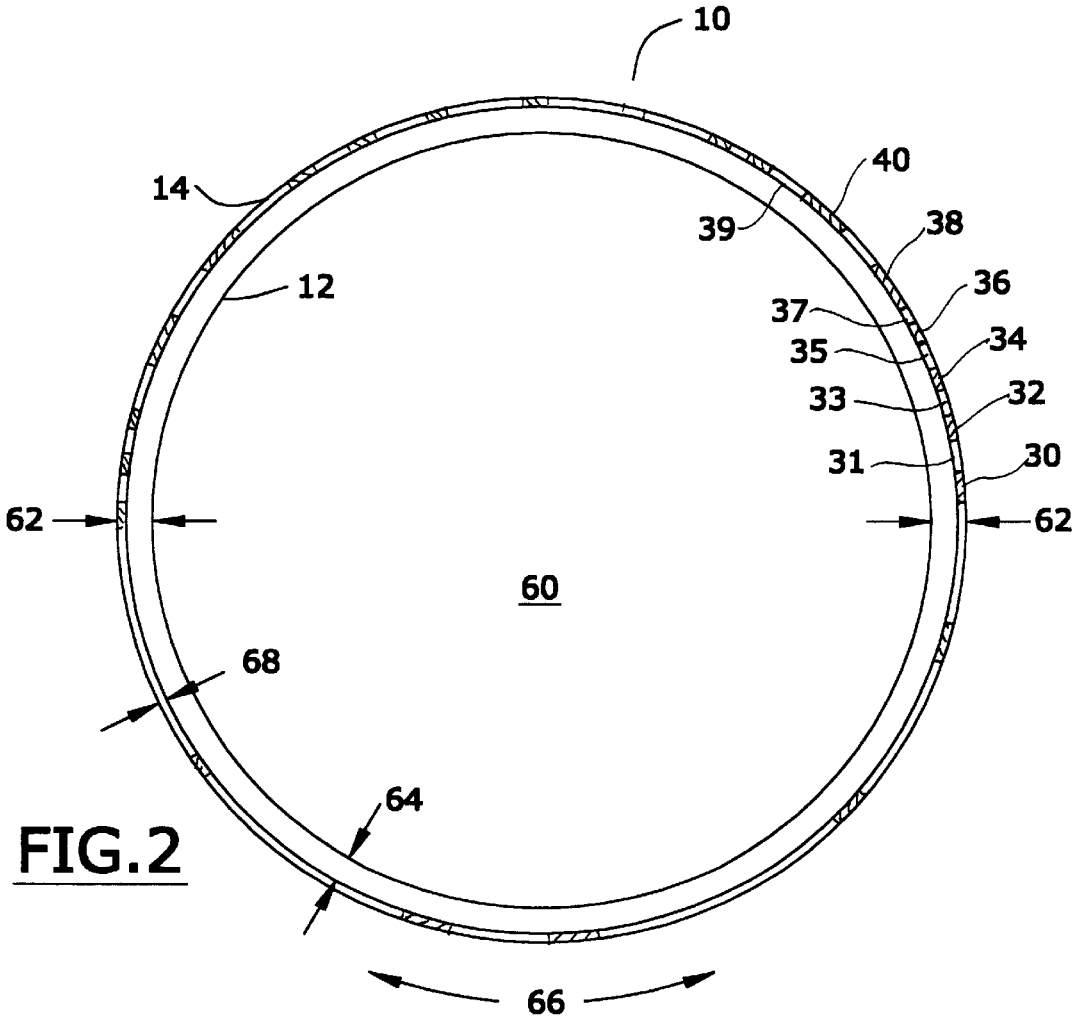
FIG. 2 is a sectional view of the ring of FIG. 1.

FIG. 2 is a sectional view of the ring of FIG. 2, taken transversely through the center of ring along line 2—2. Referring to FIG. 2, it will be seen that ring 10 has an inner diameter 60 and an outer diameter. In general, the inner diameter ranges from about 0.55 inches to about 0.93 inches. The thickness 64 of the ring 10 generally ranges from about 0.03 to about 0.08 inches and, preferably, is in the range of from about 0.06 to about 0.08 inches. Thus, the outer diameter 62 ranges from about 0.61 to about 1.09 inches.

Referring again to FIG. 2, the ring 10 has a circumference 66 of from about 1.7 to about 3.5 inches. Disposed about the outer surface 14/circumference 66 (which are congruent with each other but are shown as separate lines in FIG. 2 for simplicity of representation) are a multiplicity of recessed shapes 30, 32, 34, etc. (see FIG. 3). These recessed shapes are also often referred to as "pockets" in this specification.

Figure 3:
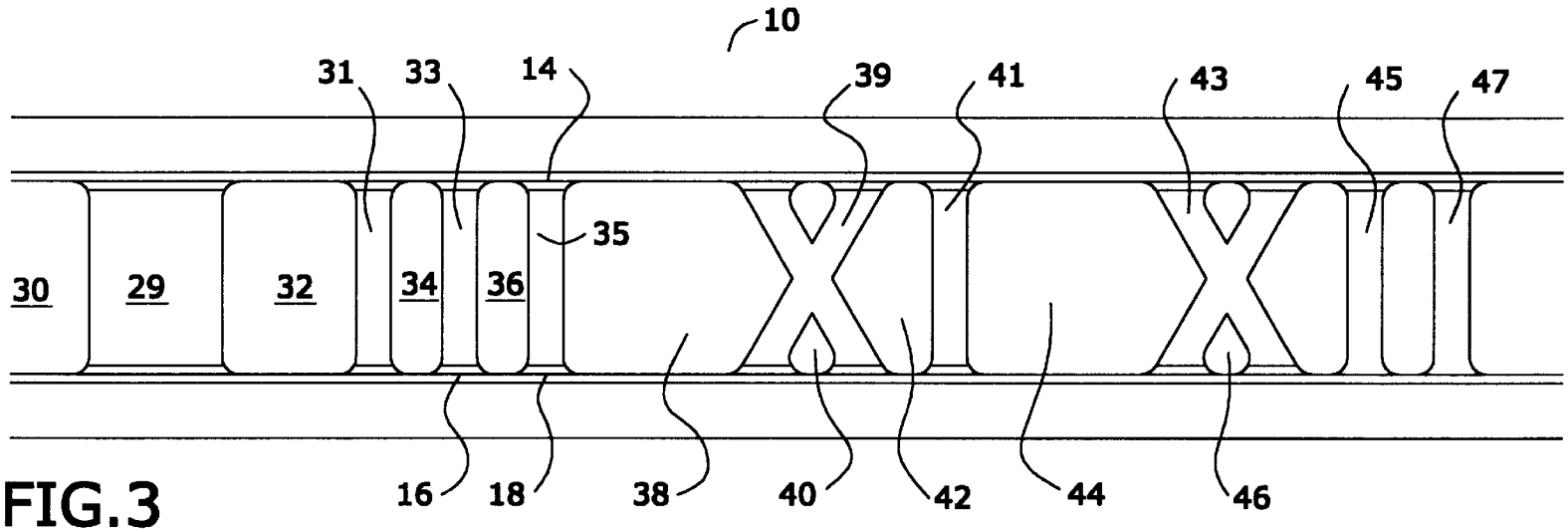
FIG. 3 is a top view of a portion of the ring of FIG. 1.
Figure 3A:
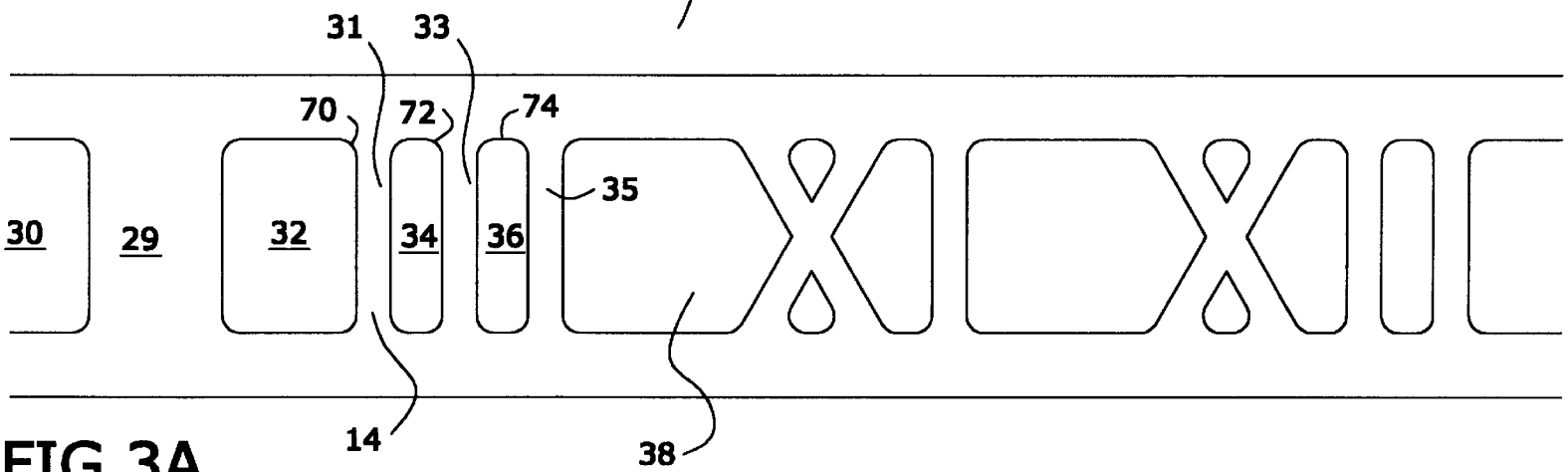
FIG. 3A is a top view of a portion of a ring similar to that of the ring of FIG. 1 but which lacks the annular grooves present in applicants' claimed ring.

FIG. 3 is a side view of the ring 10 in which, for simplicity of representation, the ring 10 is shown as a flat, linear section. FIG. 3A is a similar side view of a ring (not shown) which is identical to ring 10 in all respects except for the fact that it does not contain annular grooves 16 and 18. It will be apparent that the presence of the annular grooves 16 and 18 transforms a ring 11 (see FIG. 3A) with an appearance which is, at best, nondescript, into a ring 10 which an attractive, striking appearance. Applicants initially attempted to market a ring with the design depicted in FIG. 3A to Tiffany and Company of New York City, N.Y. but were informed that such a ring design was unsaleable. When the modified the design of FIG. 3A to incorporate the annular grooves 16 and 18, the design was so transformed that the ring of FIGS. 1 and 3 have become a substantial commercial success.

For purposes of illustration, and referring again to FIG. 2, it will be seen that recessed shape 30 has a depth 68 of from about 0.01 to about 0.03 inches, and, preferably, from about 0.02 to about 0.03 inches. Each and every recessed shape disposed between annular grooves 16 and also has a depth 68 of from about 0.01 to about 0.03 inches.

Referring again to FIG. 3, it will be seen that recess 38 is shown to be contiguous with annular grooves 14 and 16. Inasmuch as both recess 38 and annular grooves 14 and 16 are defined by the absence of material in them, then recess 38 communicates with each of annular grooves 14 and 16. In fact, each and every recess in ring 10 communicates with each of annular grooves 14 and 16.

Without wishing to be bound to any particular theory, applicants believe that the fact that their recesses communicate with their annular grooves contributes the what appears to be sharply define linear surfaces in their design. Referring to FIG. 3A, it will be seen that the presence of a groove 16 with which recessed areas 32, 34, and 36 communicate deemphasizes the presence of arcuate surfaces 70, 72, and 74 which are formed during the machining operation; although it is desirable to have linear surface, because of limitations in the machining process such arcuate surfaces are formed. However, the use of a shaped groove 16 masks such arcuateness and fools the eye into thinking that upraised number 31 in fact has a sharply defined linear top.

It is preferred that there be at least 10 recessed areas 32, 34, et seq. disposed between annular grooves 16 and 18 and extending around outer surface 14. It is more preferred that there be at least 15 of such recessed areas 32 et seq, and it is even more preferred that there be at least 20 of such recessed areas. In one embodiment, there are at least about 25 such recessed areas.

Figure 4:
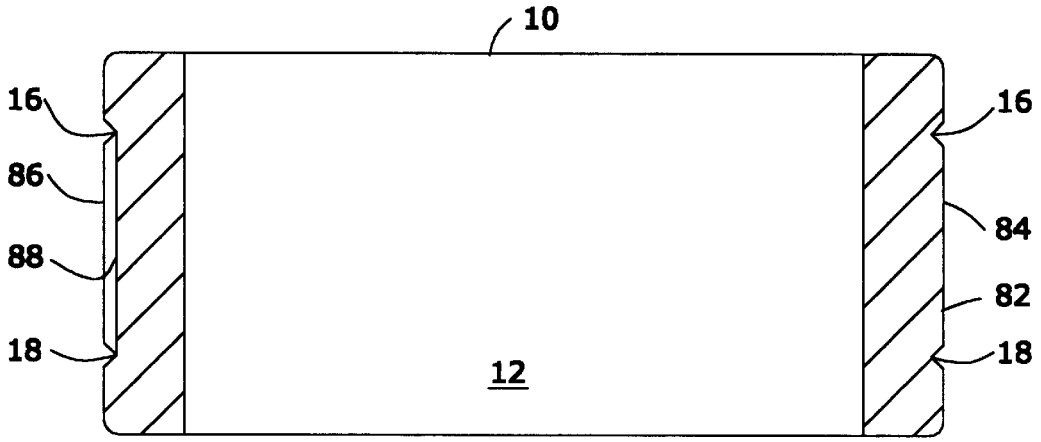
FIG. 4 is a sectional view of the ring of FIG. 1 illustrating the two annular grooves disposed in such ring.
Figure 6:
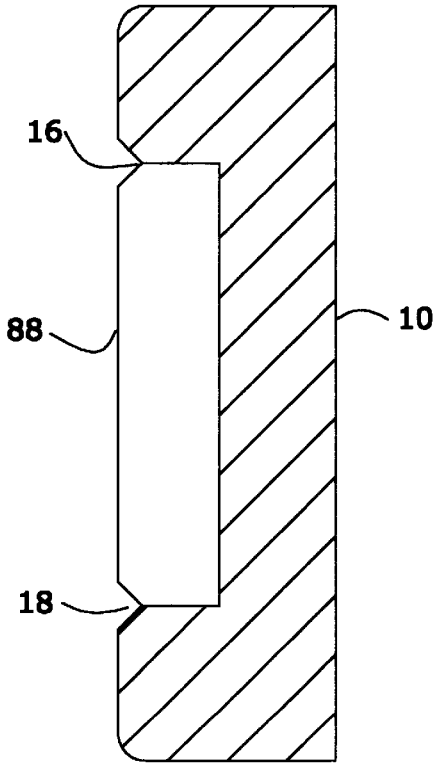
FIG. 6 is an exploded view of another portion of FIG. 4, showing how the annular grooves on the ring communicate with the recesses.

FIG. 4 is a sectional view of ring 10. Referring to FIG. 4, it will be seen that on one side 82 of ring 10 a raised indicia 84 is disposed between annular grooves 16 and 18, whereas on the other side 86 of ring 10 a recess 88 is disposed between annular grooves 16 and 18 (shown partially in outline). This is shown in more detail in FIG. 6; note that the recess 88 communicates with and blends into the annular grooves 16 and 18.

Figure 5:
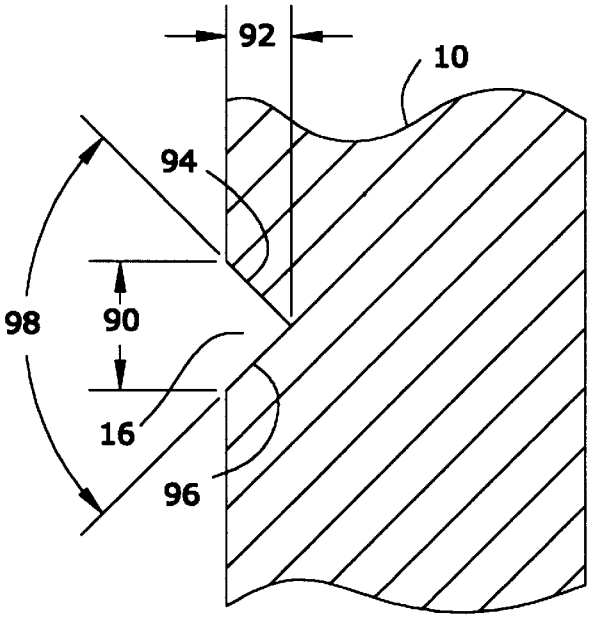
FIG. 5 is an exploded view of a portion of FIG. 4, showing one of such annular grooves in more detail.

Referring to FIG. 5, it will be seen that annular groove 16 preferably has a width 90 of from about 0.01 to about 0.02 inches, and a depth 92 of from about 0.008 to about 0.018 inches. Applicants have discovered that, if the annular groove 16 and/or the annular groove 18 has dimensions anywhere outside these ranges, the appearance of the ring 10 suffers substantially.

Referring again to FIG. 5, it will be seen that, in the preferred embodiment depicted, annular groove 16 has a substantially V-shape with a linear arm 94, a linear arm 96, and an angle 98 disposed therebetween. Angle 98 is preferably an acute angle of from about 45 to about 75 degrees.

In another embodiment, not shown, annular groove 16 has a substantially arcuate shape such as, e.g., a semicircular shape. In yet another embodiment, annular groove 16 has a substantially rectangular or square shape. In yet another embodiment, annular groove 16 has an irregular shape.

One of the critical features of applicants' claimed ring is that the indicia defined by the recessed areas, which extend upwardly from the recessed areas, each contain at least four arcuate surfaces and at least two linear surfaces.

Figure 7:
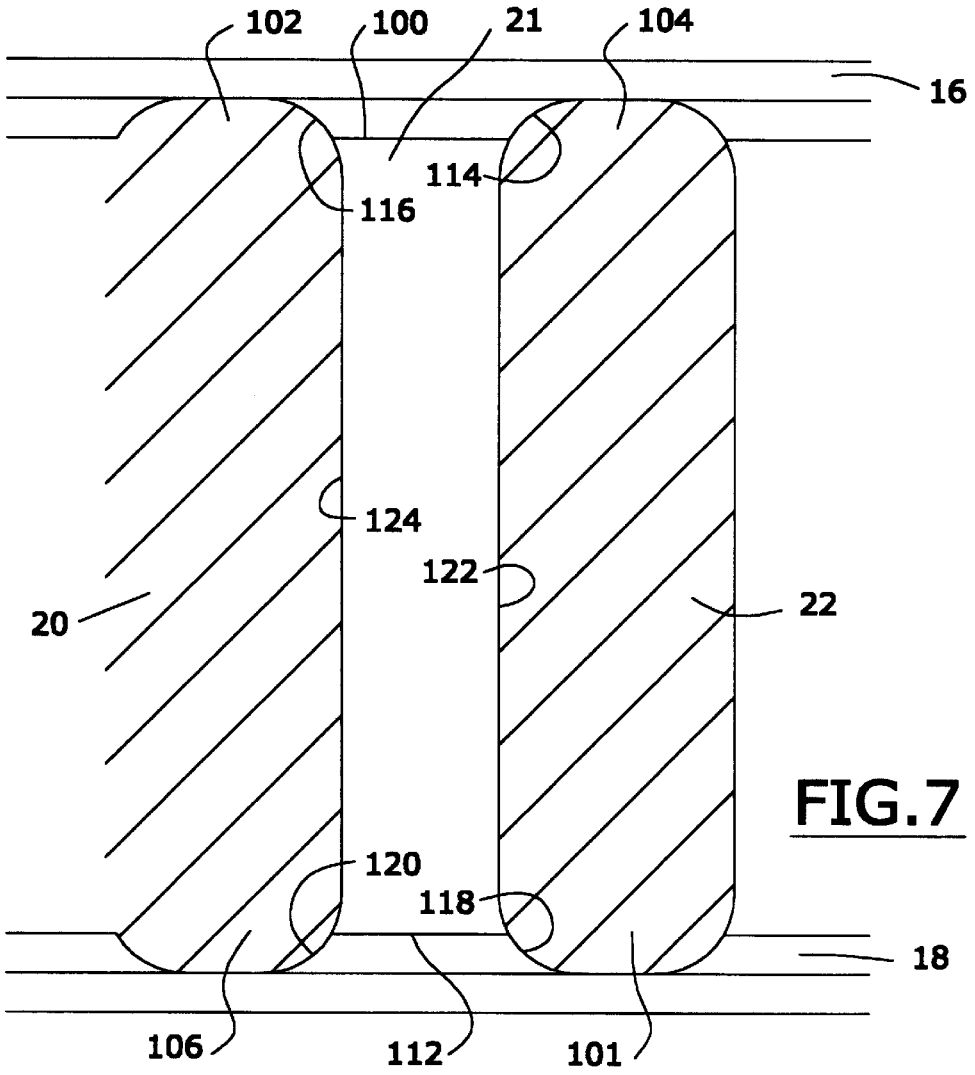
FIG. 7 is an enlarged front view of the preferred ring of this invention which illustrates how the raised indicia on such ring have a multiplicity of arcuate surfaces.

FIG. 7 is an enlarged top view of a section of the ring 10 of FIG. 1. Referring to FIG. 7, it will be seen that, because sections 102, 104, 106, and 108 communicate with and blend into annular grooves 16 and 18, and because the color and texture within grooves 16 and 18 and recesses 20 and 22 (see FIG. 1) are preferably substantially identical (all of which have preferably been sandblasted using the same conditions), linear sections 110 and 112 are sharply defined for the viewer's eye. Furthermore, because recesses 22 and 22 are machined so that they contain a combination of linear and arcuate surfaces, the upraised indicia 21 defined by reccesses 20 and 22 and by grooves 16 and contains both arcuate surfaces 114, 116, 118, and 120 as well as linear surfaces 122 and 124. In fact, each and every upraised indicia disposed between annular grooves 16 and 18 contains at least four such arcuate surfaces and at least two such linear surfaces.

Figure 7A:
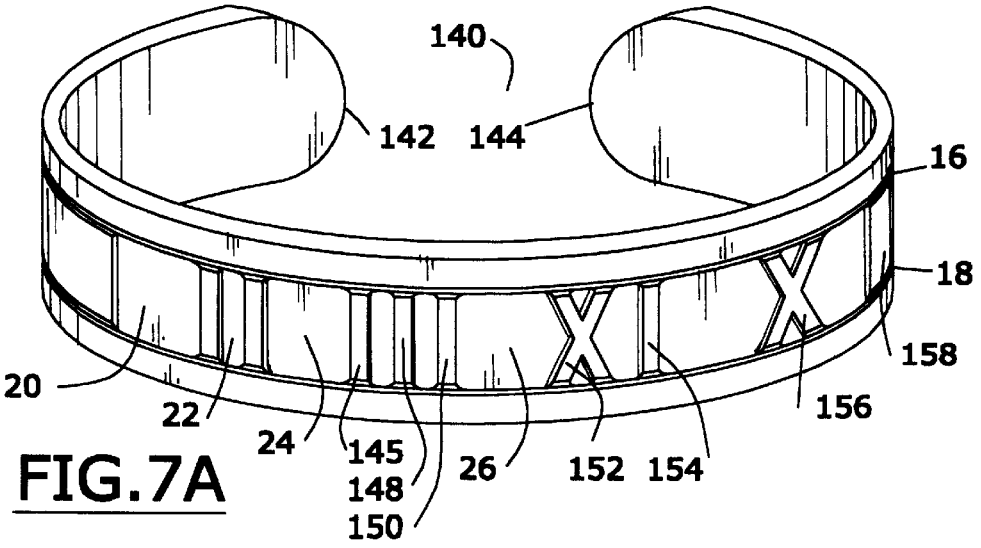
FIG. 7A is a perspective view of a bracelet or earing structure which can be made with the process of this invention.

FIG. 7A is a perspective view of another piece of jewelry which may be made by the process of this invention, an arcuate, discontinouous ring 140. The ring 140 is discontinous in that its ends 142 and 144 are not contiguous and integrally joined to each other. In other respects, however, the ring 140 is similar to the ring 10. Thus, it contains annular grooves 16 and 18, recesses 20, 22, 24, and 26, and raised indicia 146, 148, 150, 152, 154, 156, 158, etc.

The ring 140 may be made from the same tubular stock or strip as the ring 10. After the annular grooves 16 and 1 8, the recesses 20 et seq, and the raised indicia 146 et seq are machined into the circular stock, the ring so machined can be cut to for a structure with discontinuous ends 142 and 144. The structure may be substantially circular, or it may be compressed or extended to form one or more other arcuate shapes.

The ring 140 has a partial circumference (the distance, going counterclockwise,, from end 142 to end 144) which varies with its usage. When the ring 140 is in the shape of an earing, it will have a partial circumference of from about 1.2 to about 2.4 inches. Thus, e.g., it may have the shape of and the size of the "earings for pierced ears" shown on page 34 of Tiffany & Co.'s "Summer Selections 1999" catalog (published by Tiffany & Co., 15 Sylvan Way, Parsippany, N.J., 5477).

By way of further illustration, when the ring 140 is in the shape of a bracelet, it will have a partial circumference of from about 7.0 to about 9.0 inches. Thus, e.g., it may have the shape and the size of the "Cuff bracelet" shown on page 34 of the aforementioned Tiffany & Co. catalog. Although the jewelry shown in such catalog has an appearance similar to that of applicants' claimed rings, they do not the desired advantageous properties such as, e.g., the low porosity and high tensile strength. Without wishing to be bound to any particular theory, applicants believe that these inferior properties are due to the fact that the Tiffany & Co. rings are produced by a more cumbersome, more expensive, less effective casting process.

Figure 8:
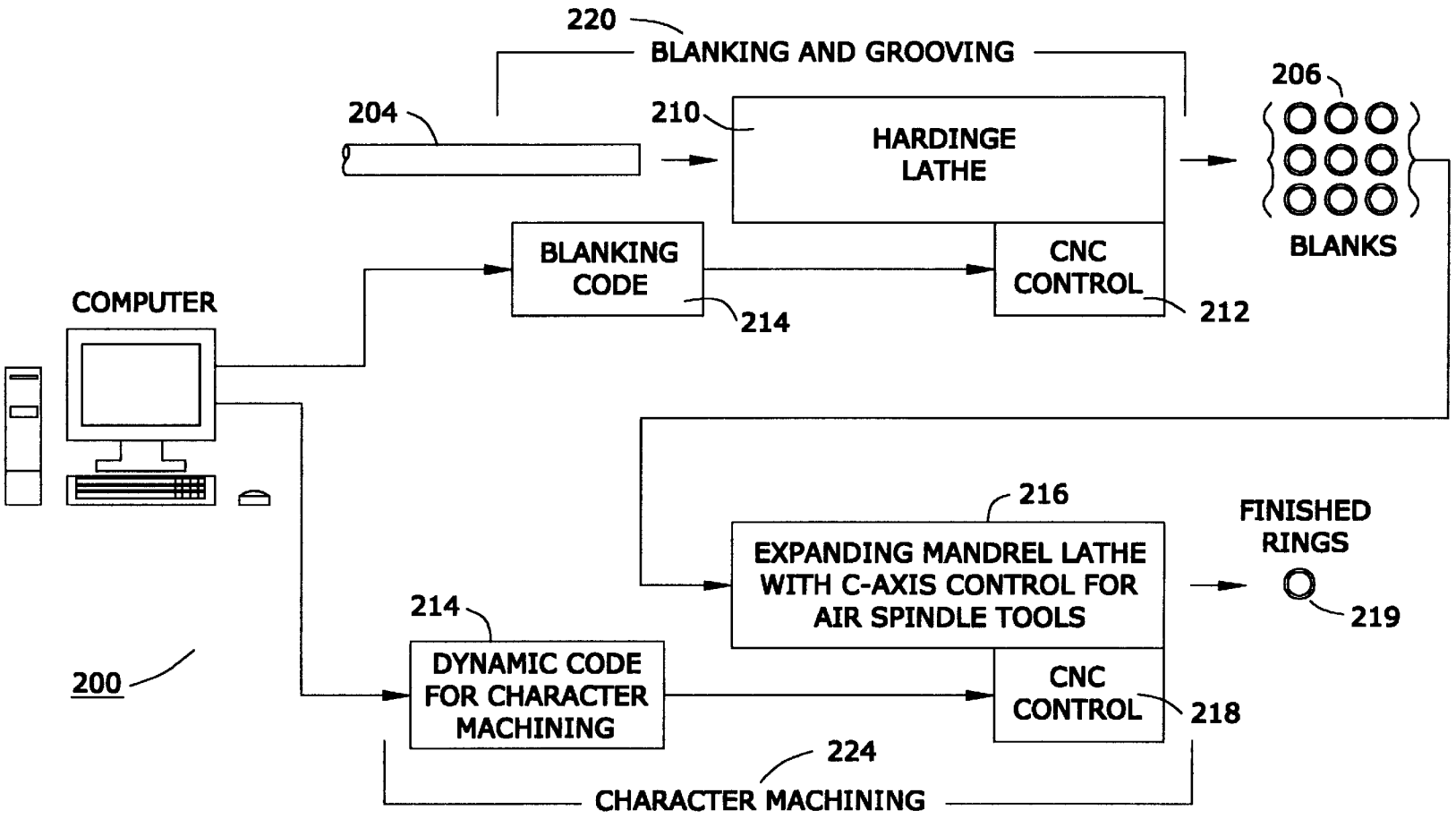
FIG. 8 is a schematic illustration of the components employed for the manufacture of a ring such as the ring of FIG. 1.

Referring now to FIG. 8, depicted therein is a preferred system 200 for the creation of rings in accordance with the present invention. In particular, the system employs computer-controlled machining equipment (e.g. computerized numeric control (CNC)) to automatically operate the lathe(s) and associated tools. A system, or piece of equipment associated therewith, performs an operation or a function "automatically" when it performs the operation or function independent of concurrent human control.

In a very general form the process consists of the input of raw material in the form of a tubular precious-metal stock 204 such as that previously described. The stock is first "blanked and grooved" at step 220 where a pair of parallel grooves (16 and 18 of FIG. 4) are cut into the outer diameter of the tubing stock and the ring blank is subsequently cut-off from the tubing stock. The output of step 220 is a ring blank 206. Subsequently, blank 206 is mounted on an expanding mandrel and the characters or features of the ring are machined into (and in some applications through) the outer surface of the ring blank, step 224. The output of the character-machining step is a semi-finished ring that may require further polishing or other appearance improving processes.

In the preferred embodiment depicted in FIG. 8, the two general steps are accomplished on separate machines. Although it is possible to complete aspects of the following process using a single machine, the use of two machines improves productivity as it avoids the need for frequent changing of tools and types of tools in order to complete the machining process. The first general step of blanking and grooving is preferably completed on a Hardinge lathe 210 (a Hardinge model "Cobra 42" manufactured by the Hardinge company of upstate New York). The lathe and its associated tooling arc operated using a CNC control 212 that is response to software 214 referred to as "G-code," as is well-known to those skilled in the art. The software, as found in the Appendices, is preferably created on a data processing system and downloaded to the CNC controller at the start of a run of the job. Similarly, a second lathe 216, a "model GT27" lathe manufactured by the CMS company of Pasadena, California and equipped with live tooling supplied by NSK company of Japan, is preferably outfitted with an expanding collet or mandrel and operated under the automated control of CNC controller 218 and is employed to complete the machining of the characters.

The specific operations performed by the system will now be described in more detail with respect to FIG. 8. Beginning with the input material 204 (FIG. 8), a precious-metal tube (e.g., silver or gold) is obtained, the dimensions of the tube being specified as a function of the ring size to be produced. The tubing stock is fed into a computer-controlled lathe 210, and the CNC controller 212 is programmed to machine the blank for the production of each type of ring. Exemplary "G-code" programs for the machining of grooves and creation of ring blanks are found in Appendices A (Narrow Roman Numerals) and B (Large Roman Numerals).

The blanks 206 produced on the first computer-controlled lathe 212 are then placed onto an expanding collet or mandrel on the second computer-controlled lathe 216. This second lathe is equipped with a computer or CNC controlled spindle commonly referred to as a "C"-axis. This allows an air operated spindle, preferably mounted on the saddle of the lathe in the X-axis direction, to hold a small "end mill" in order to machine or cut an outer surface of the ring. By computer control of the movement of the spindle, in conjunction with the movement of the X- and Z-axes, it is possible to produce various unique or repeating patterns such as, but not limited to, a ring with several Roman numerals spaced around the ring and bar. Moreover, the ring may include a sizing region or band that allows it to be sized either up or down at a future time. In a preferred embodiment, the main cutting end mill is 0.032 inches in diameter and a second air spindle, mounted on the saddle of the lathe directly opposite the first air spindle, includes a 0.015 inch cutter and is used to sharpen the corners on the pattern such as the inside of a Roman numeral character.

It will be appreciated that other sizes of cutters or combinations thereof may be used, but experience and observation suggests that the combination of 0.032 inch & 0.015 inch diameter end mills are the most efficient with regard to production time while providing an acceptable machining quality level. Furthermore, although air spindles have been employed, an electric-motor propelled spindle will also be satisfactory.

In a preferred embodiment of the ring-making process, after machining the rings 219 are then polished in the bore and a maker's mark stamped on the inside of the rings. Subsequently, a plurality of the rings are assembled on an arbor (preferably about 20 rings per arbor) and sand blasted to give a white finish in the recesses remaining after the machining. After sandblasting, the recesses are filled with a paste of "yellow ocher" to protect the sandblasted surface during further polishing. When the rings have been given a very high polish the "yellow ocher" is washed out of the recesses. The rings are then immersed in a solution of potassium cyanide that imparts a very white finish in the recesses, providing a high degree of contrast to the highly polished surface.

Figure 9:
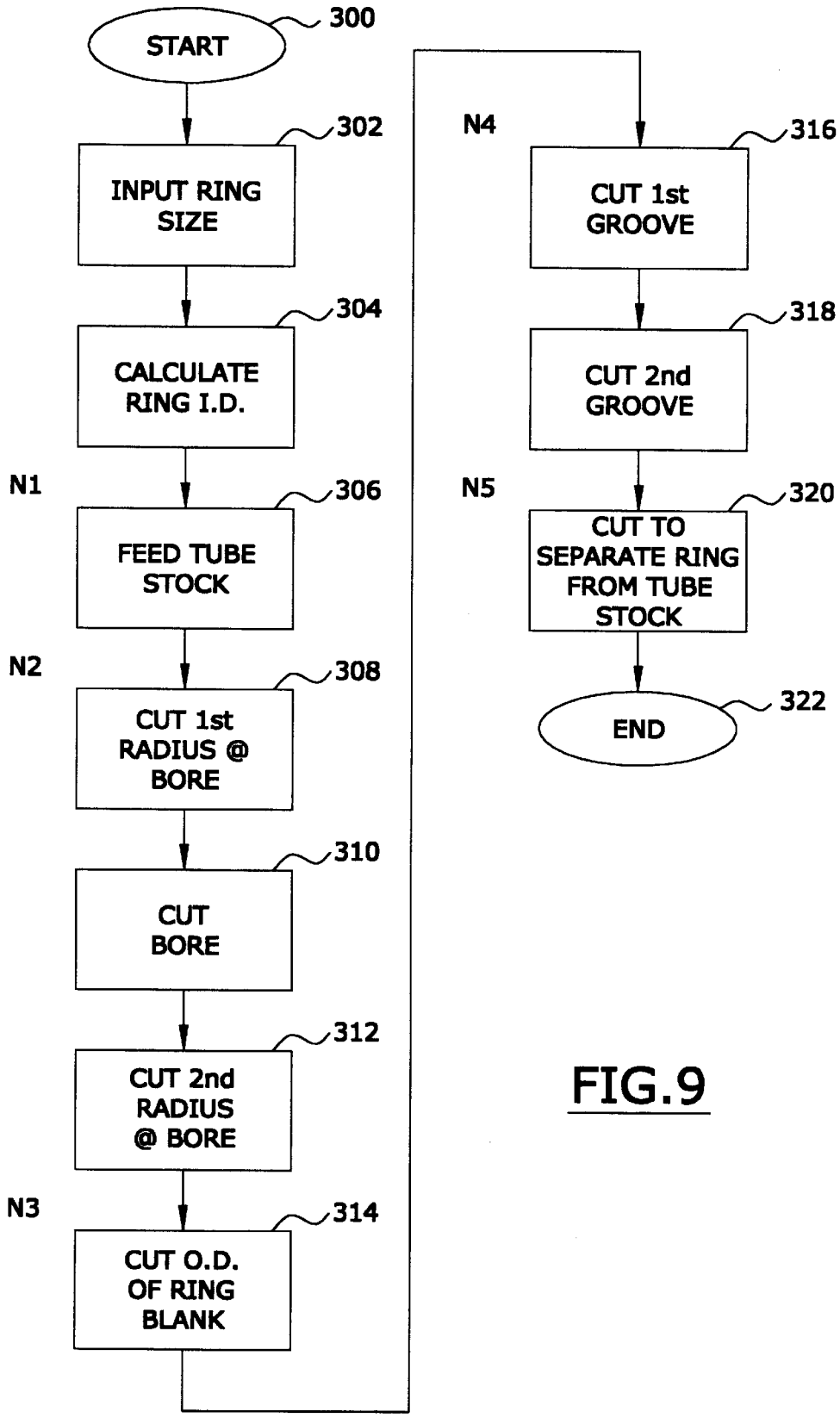
FIG. 9 is a flow chart depicting the general process steps used to create a blank of the ring from tubing stock.

Having described the specific operations completed in general steps 220 and 224, reference is now made to FIG. 9, where specific steps in the blanking and grooving operation will be described with respect to Appendix A, which is contained on the enclosed microfiche. Beginning with step 300, the CNC controller initiates the automated, programmatic operation of the lathe and associated tools. At step 302, the ring size is input and is used to calculate the ring diameter at step 304. Subsequently, at step 306 (Appendix A Ref N1) the tubing stock is fed through the lathe chuck an appropriate distance determined by the desired ring width.

After advancing the tube stock, the first internal radius is cut using a boring tool (Appendix A Ref. N2) at step 308 followed by cutting the bore (internal diameter is a function of the ring size as previously calculated) step 310 and the second internal radius 312. Having completed steps 308–312, the internal dimension and radii of the ring are complete. Next, beginning with step 314 (Appendix A Ref. N3), the outside diameter of the ring blank is cut.

After the outside diameter is completed, the preferred embodiment for the Roman Numeral rings uses steps 316 and 318 (Appendix A Ref. N4) to cut a pair of annular grooves about the periphery of the outside diameter. As has been previously described, the annular rings facilitate the machining and appearance of the finished ring. Finally, at step 320 (Appendix A Ref. N5), the ring blank is separated from the tubing stock and the automated program is completed. Although not thoroughly described herein, it will be apparent to those familiar with "G-code" that the software programs in Appendices A and B (see the enclosed microfiche) are complete numerical control programs suitable for creating ring blanks as has been described in accordance with the preferred embodiment. It will also be appreciated that each of the general steps described above are significantly more detailed and that the comments found in the Appendices provide further detail for a preferred embodiment.

Having described the blanking process, attention is now turned to the character machining process depicted in detail in the flowcharts of FIGS. 10A–10J. It will be appreciated that, although the process is described with respect to a Roman Numeral character machining process, the steps herein may also be applicable to machining other characters or symbols on the outer surface of, or completely through, a ring. Other characters and symbols include various alphabets and fonts, and may be used, in particular, to customize rings with birth dates, names or other personal information.

As can be seen from the flowcharts, and associated Appendix C (see the enclosed microfiche), and the further example of Appendix D (see the enclosed microfiche), the present program calculates the spacing of the numerals by calculating the diameter and perimeter of the outer surface of the ring. The distance is then divided by the required number of numerals and adjustment made to the spacing and the width of the sizing band to fit the numerals to the size of the ring. Using this technique it is possible to use a common program for a range of ring sizes. As a result, this method improves the efficiency of the ring machining process, because it is quicker to change from one ring size to another (no program change required) and conserves the limited computer memory found in computer controlled machines (no need to store multiple programs; one for each ring size). While it may be possible to produce a similar ring using a "CAD" (Compeer Aid Drafting) drawing of a ring, it would be necessary to draw each ring size, thereby making the character spacing adjustments during the CAD process. The CAD output (drawing) could then be converted to the type of instructions that a computer controlled machine might employ to machine characters in the surface of the ring.

Figure 10A:
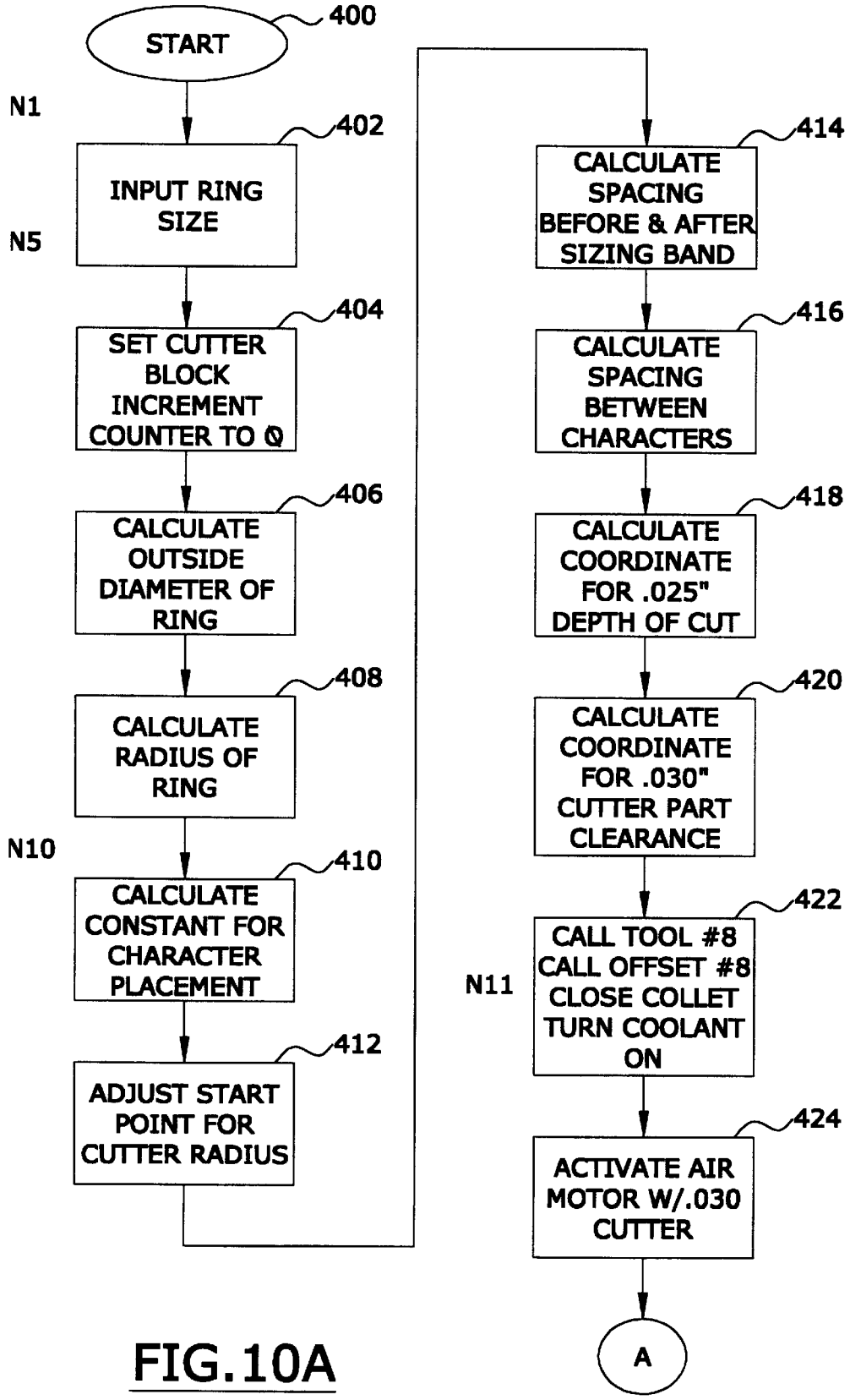
FIGS. 10A—10J are flow charts depicting the general process steps used to machine the multiplicity of recessed shapes as seen on the ring of FIG. 1.
Figure 10B:
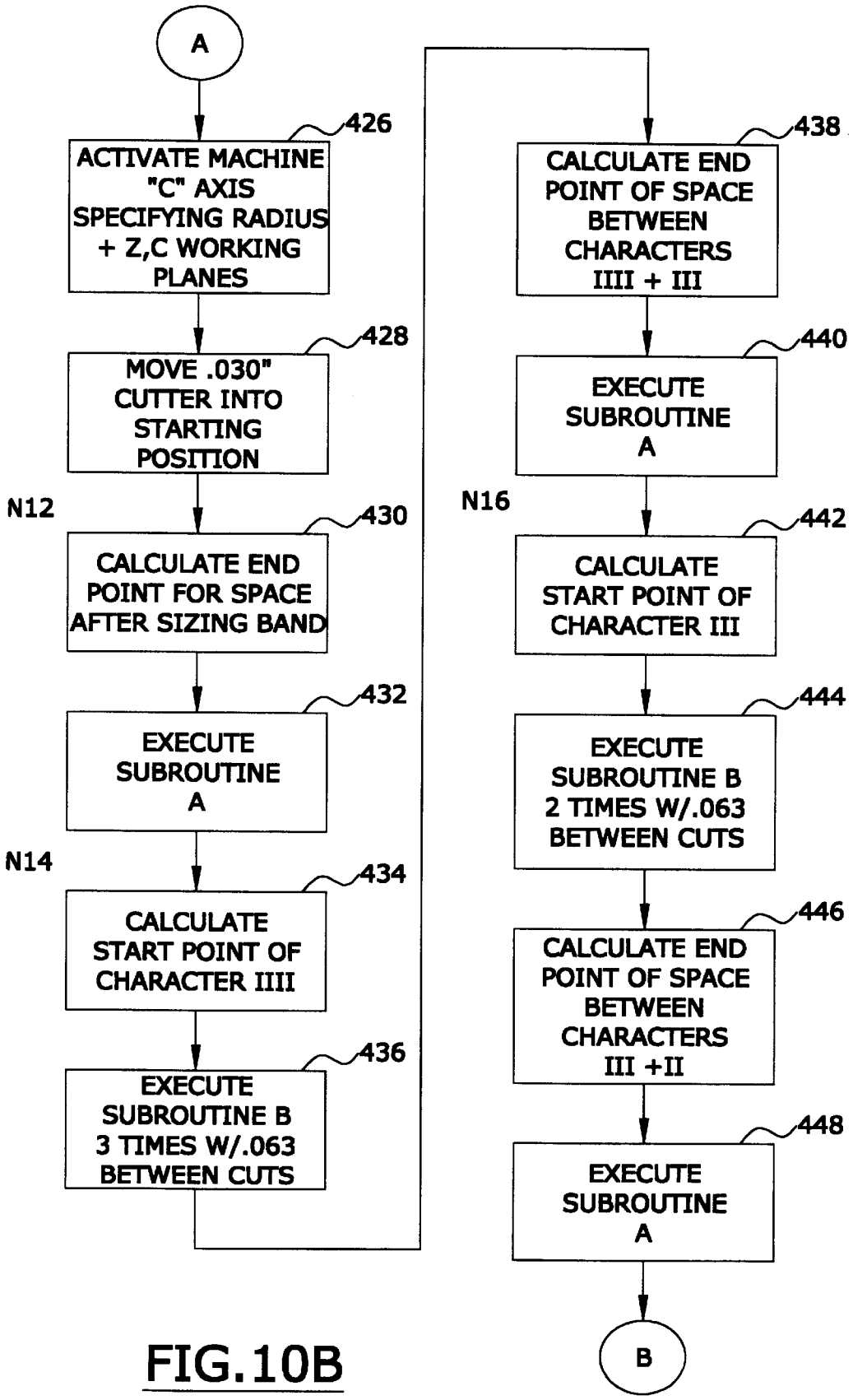
Figure 10C:
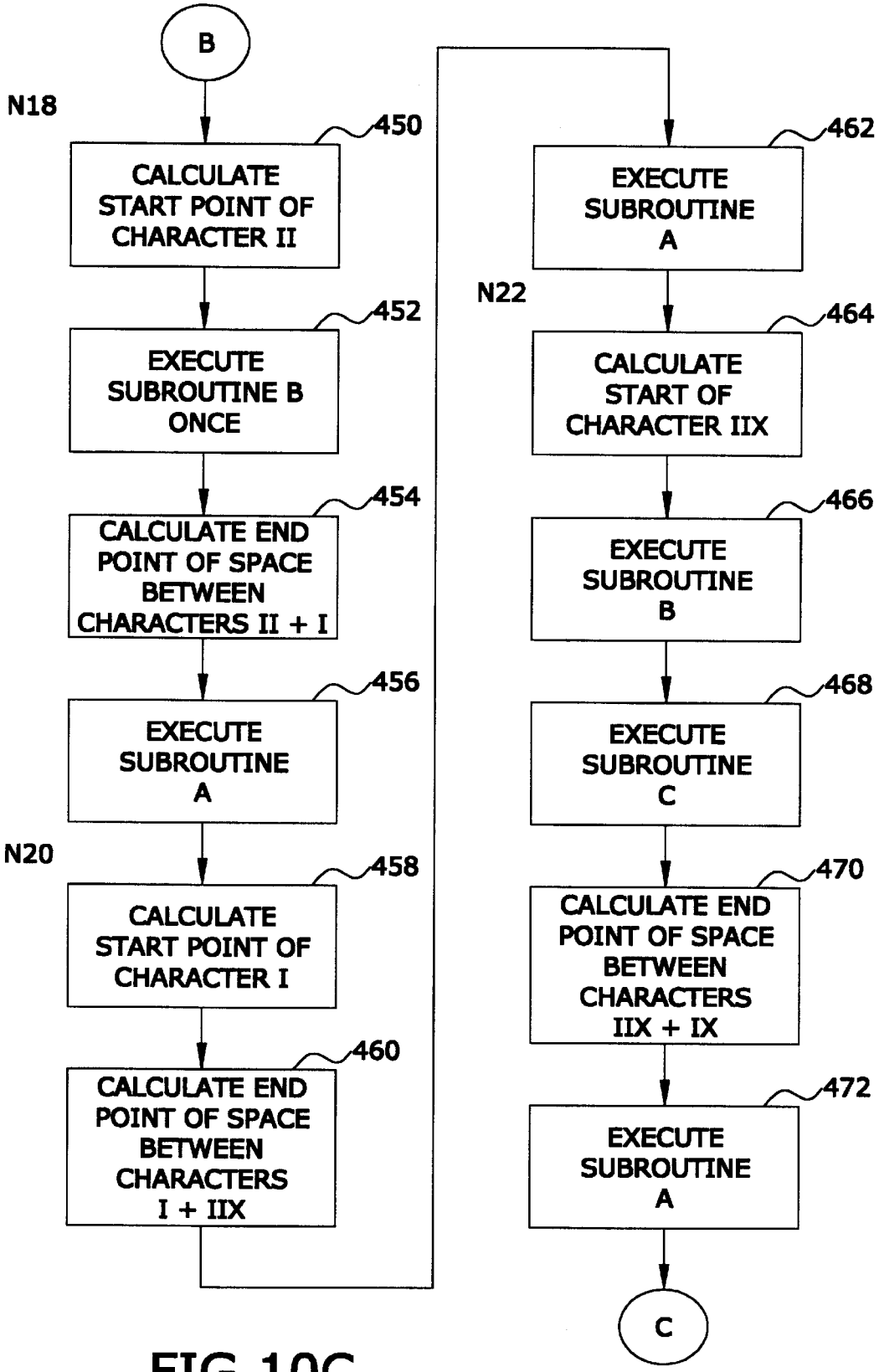
Figure 10D:
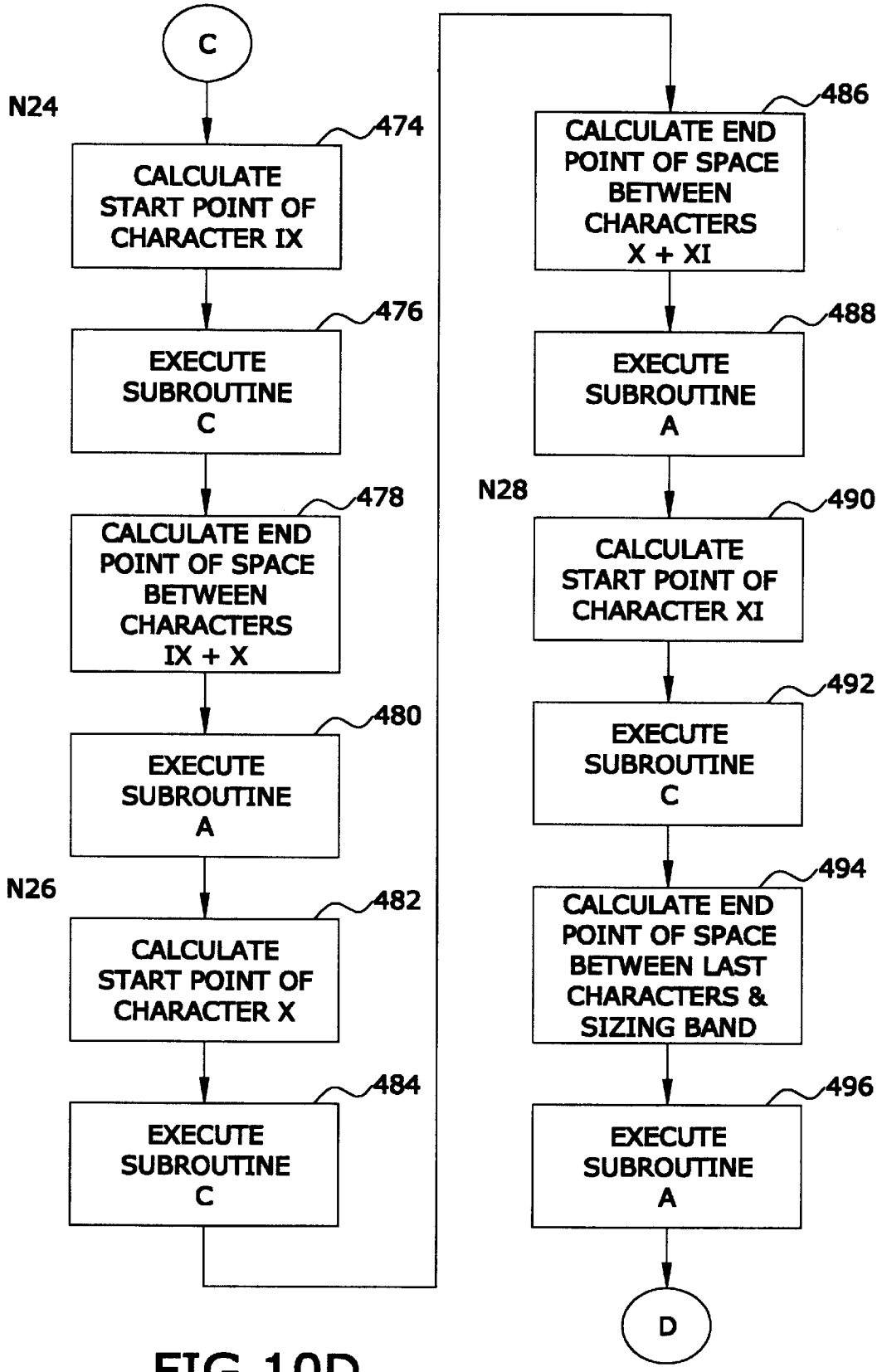
Figure 10E:
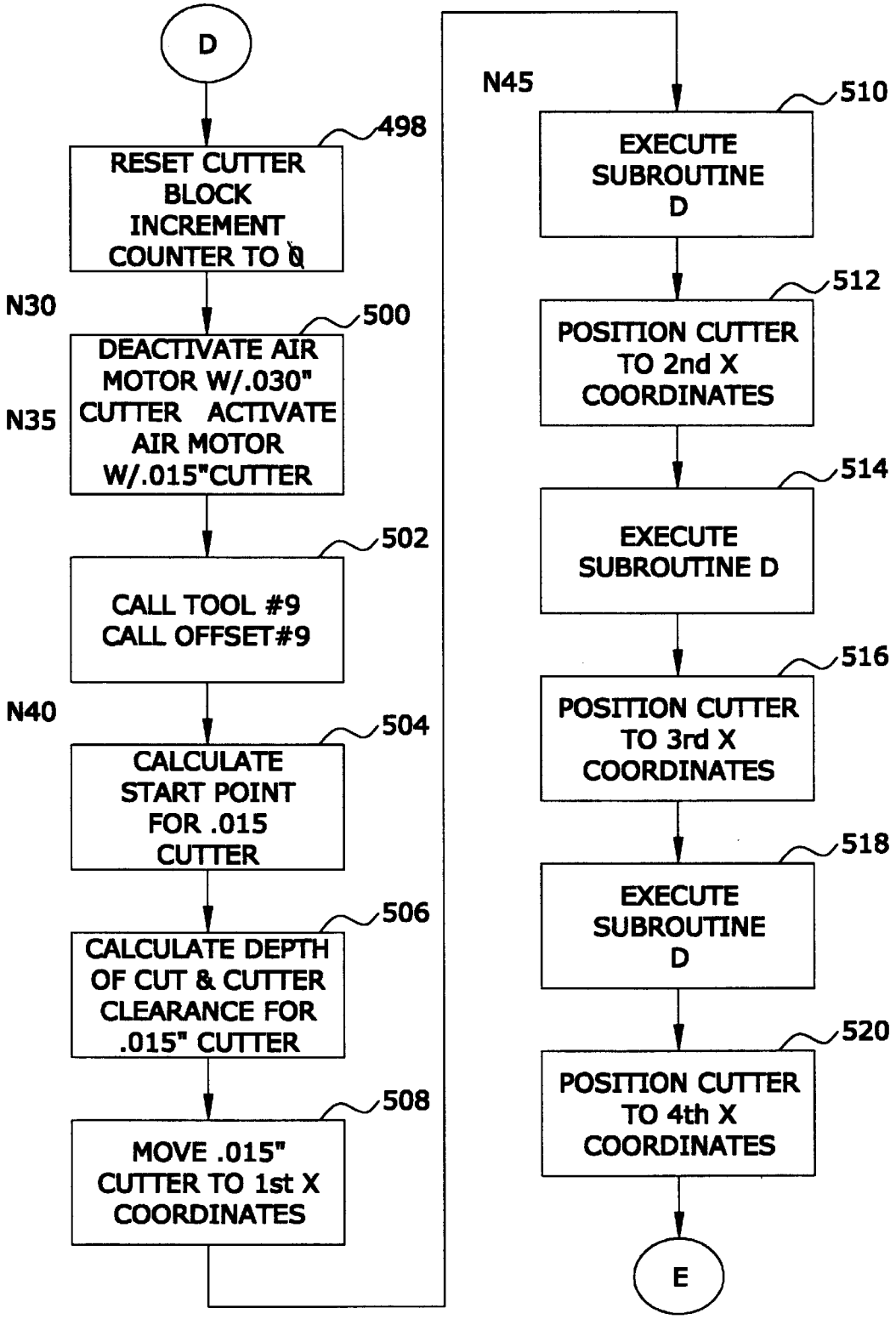

Turning to FIG. 10A, the program begins at step 400 and is initiated at step 402 (Appendix C Ref. N1) where the ring size is input. A cutter block incrementing counter is cleared at step 404 and the outside diameter of the ring and radiuses are calculated at steps 406 and 408, respectively. Next, beginning at Appendix C Ref. N10, a constant is calculated for character placement based upon the ring size. The start point is adjusted for the cutter radius at step 412 and the spacing before and after the sizing band is calculated at step 414. Step 416 calculates, based upon ring size as well, the spacing between the characters. At step 418 the coordinates for a 0.025 inch cut depth are calculated, however, it will be apparent that the depth is a function of the desired appearance and that shallower cuts, deeper cuts or through-cutting may be employed. Also, at step 420, the coordinates for the characters and recesses are calculated based upon a 0.030 inch cutting mill diameter.

Beginning at step 422 (Appendix C Ref. N11) a 0.030 cutting tool is attached, the collet or mandrel is expanded to engage the inside diameter of the ring blank, and the cutting coolant is turned on. At step 424 the tool motor is activated followed by the activation of the C-axis and a specified radius and working plane at step 426. Step 428 moves the cutting tool to its starting position. Subsequently, in a programmatic pattern that will be repeated, step 430 (Appendix C Ref. N12), the endpoint of the recess to be machined is calculated and a call is made to Subroutine A, step 432.

Figure 10F:
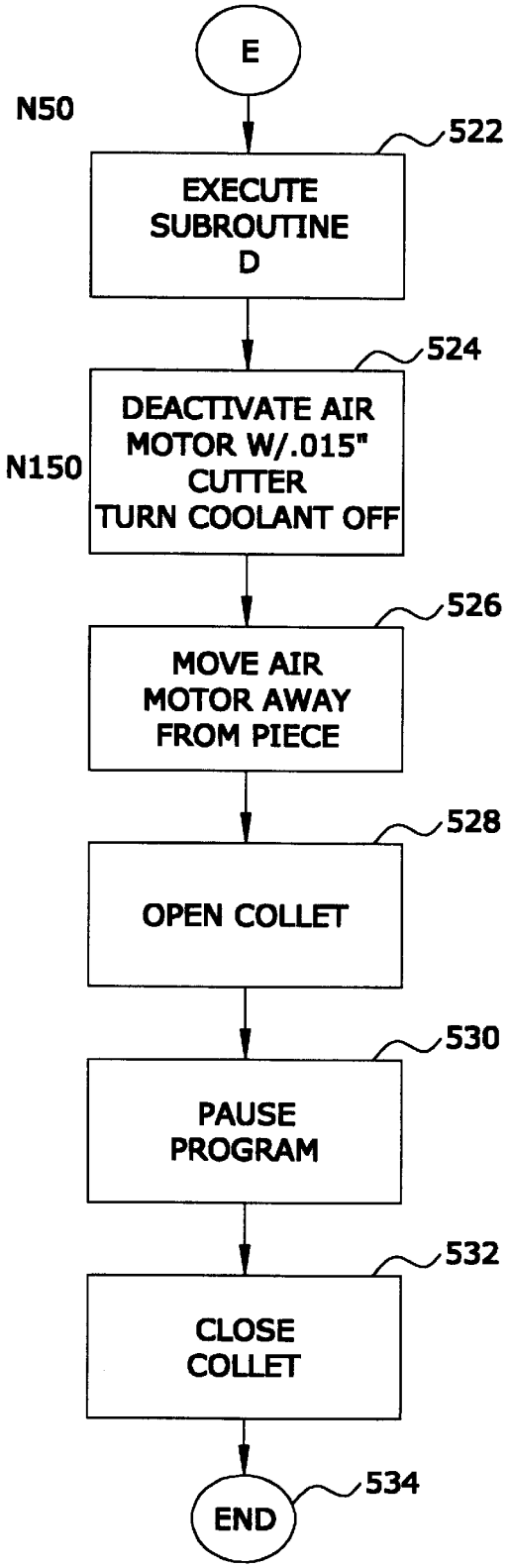
Figure 10G:
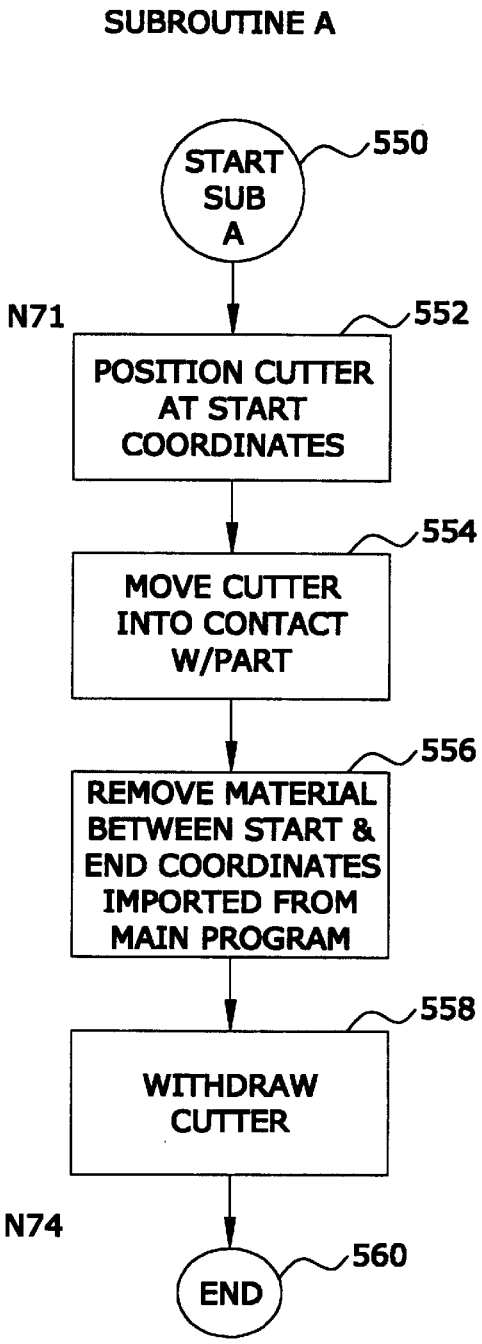

Subroutine A, as depicted in FIG. 10G, begins at step 550 (Appendix C Ref. N71). At step 552 the cutter is positioned at the starting coordinate, moved into contact with the ring blank, step 554, and moved so as to remove material from the surface of the ring blank between a set of start and end coordinates, step 556, creating a recess. Once the material is removed step 558 withdraws the cutting tool before control is returned to the main program at step 560 (Appendix C Ref. N74). It will be appreciated that there are numerous paths in which the cutting tool may traverse the area to cut away the material and create the recess. However, the preferred embodiment, determined by observation, is to use a cutting path that outlines the entire recess and then repeatedly traverses, in a back-and-forth motion, the interior of the recess.

Figure 10H:
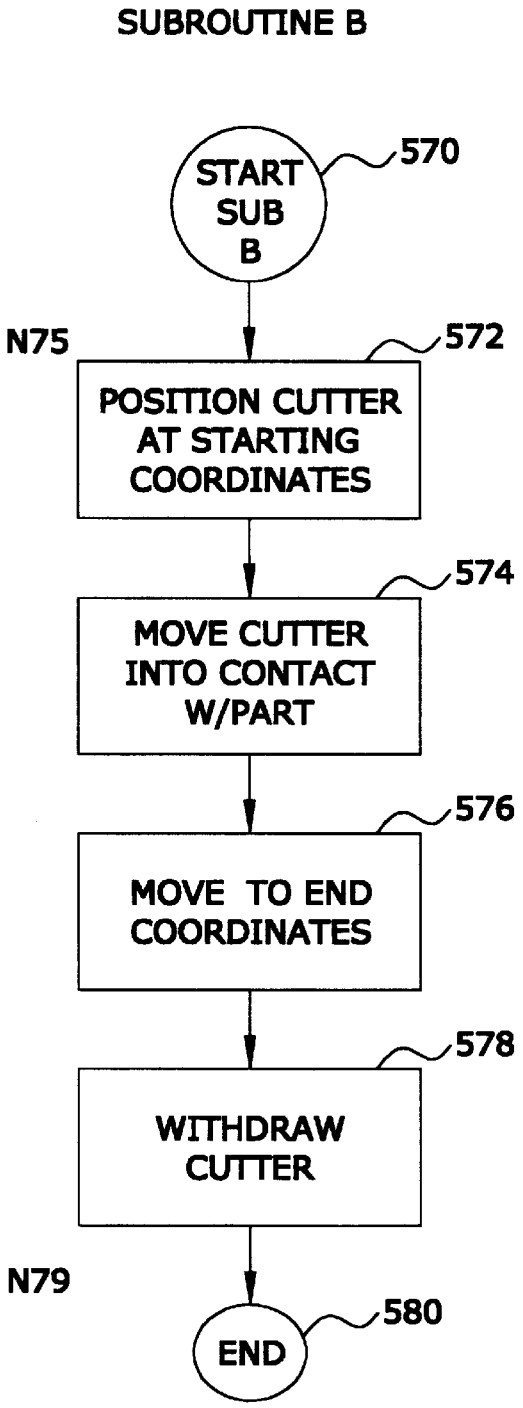
Figure 10I:
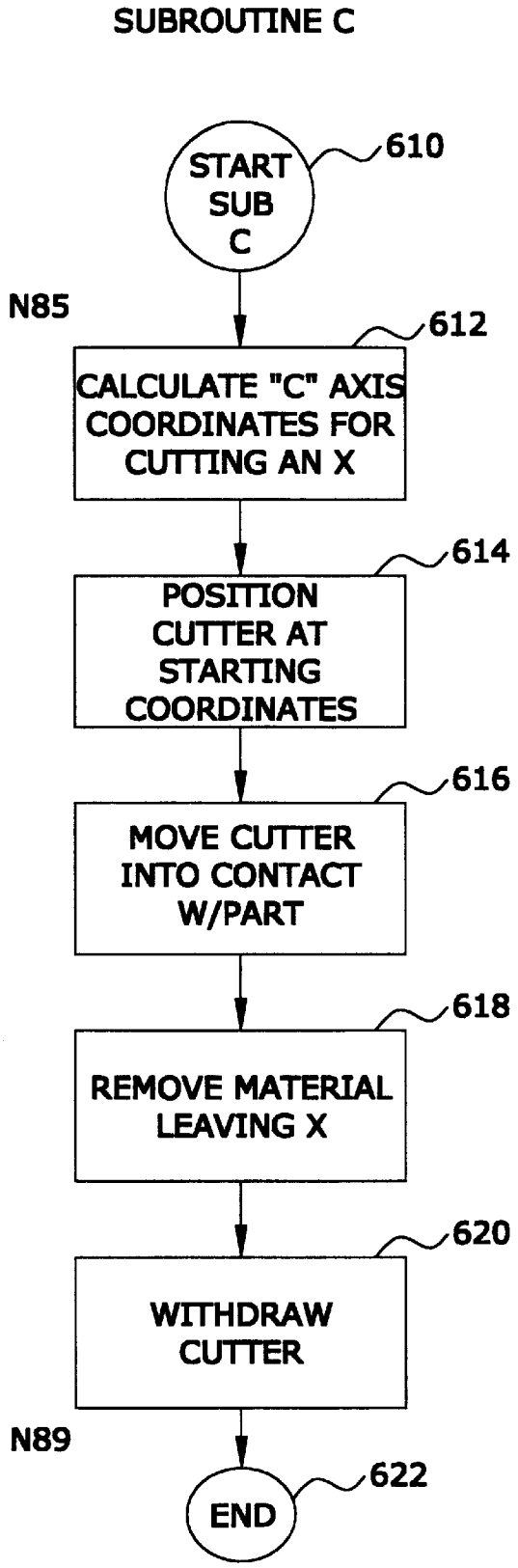

Returning to the main program, machining continues at step 434 (Appendix C Ref. N14) where the starting point of the numeral "IIII" is calculated. Subsequently, Subroutine B is called (Step 436) to execute three times; once for each of the three recesses between the characters forming the numeral. Subroutine B, as depicted in the flowchart of FIG. 10H, starts at step 570 (Appendix C Ref N75) and first positions the cutter at the starting coordinates step 572. Subsequently, the cutter is moved into contact with the ring blank at step 574, moved to its end coordinate (step 576) and withdrawn from the recess at step 578. Subsequently, control is returned to the main program at step 580 (Appendix C Ref. N79).

After executing Subroutine B three times, with 0.063 inches between each cut, the endpoint of the spacing between the numerals "IIII" and "III" is calculated at step 438. Once the endpoints are calculated Subroutine A is called at step 440 to control the removal of the material to form the recess between the numerals. Continuing at step 442 (Appendix C Ref. N16), the system calculates the starting point of the numeral "III" is calculated and step 444 calls Subroutine B two times to machine the recesses between the characters forming the numeral. Next, step 446 calculates the end point of the space between numerals "III" and "II." Subsequently, as represented by steps 448 through 462 (Appendix C Refs. N18 and N20), the program systematically machines the recesses for the characters "II" and "I" and the spaces therebetween. Starting with step 464 (Appendix C Ref. N22) the system begins the machining of character "IIX" by first calculating the starting point for the numeral. However, this time Subroutine B is called only once at step 466 (to cut recesses between the "I" characters). Subsequently, subroutine C is called at step 468 to roughly cut the spacing around the "X" character. Subroutine C starts at step 610 (Appendix C Ref. N85) where the first machining step 612 calculates the C-axis coordinate for cutting recess about "X" character. Subsequently, the cutter is positioned at the starting coordinate, step 614, moved into contact with the ring blank, step 616, and the blank and cutter are moved so as to create a "rough" recess that leaves the "X" character. Subsequently, the cutter is withdrawn at step 620 and control is returned to the main program at step 622.

Next the end point of the space between the "IIX" and the "IX" numerals is calculated at step 470 and cut via a call to Subroutine A at step 472. At step 474 (Appendix C Ref.

N24), the starting point of the "IX" character is calculated and Subroutine C is called at step 476 to again cut the recess about the "X" character. A similar process is employed for the remaining numerals "X" and "XI" as represented by steps 478 through 496.

Having completed the machining for all the "I" characters and rough machining for the "X" characters, the character machining process continues at step 498 (FIG. 10E) where the cutter block increment variable is reset to 0. Starting with step 500 (Appendix C Ref. N30), the air motor is deactivated to stop the 0.030 inch diameter tool and the motor for the 0.015 inch diameter tool is activated (Appendix C Ref. N35). At step 502 the new tool is called and moved to a predefined offset. A starting point or the 0.015 cutter is calculated at step 504 (Appendix C Ref. N40) and the depth and clearance for the recess cut are calculated at step 506. Step 508 is where the 0.015 inch diameter cutter is moved to the first "X" coordinates and a call is then made to Subroutine D (Step 510).

Figure 10J:
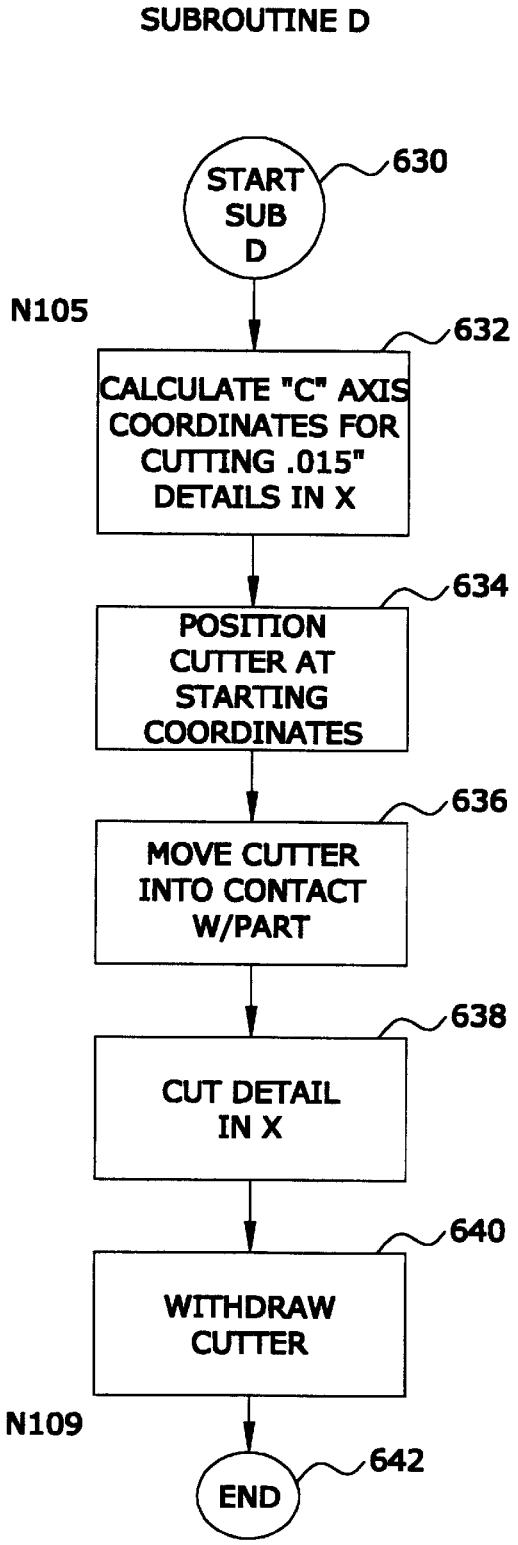

Subroutine D, as depicted in FIG. 10J, starts at step 630 (Appendix C Ref. N105) and first calculates the C-axis coordinate for cutting the details in the "X" character. At step 634, the cutter is positioned at the starting coordinates and is moved into contact with the outer surface of the ring blank at step 636. The detail of the "X" character is cut in step 638 before the cutter is withdrawn at step 640 and control returned to the main program at step 642. As understood from the descriptive comments found in Appendix C, Subroutine D cuts the two triangularly-shaped regions on either side of the "X" character. Subsequently, at steps 512 through 522 the cutter is positioned at the second, third and fourth "X" positions and Subroutine D is called to complete the machining of those characters.

Continuing at step 524 in FIG. 10F (Appendix C Ref. N150) the air motor for the 0.015 inch diameter tool is deactivated, and the cutting coolant is turned off. Subsequently, the air motor is withdrawn, step 526, and the collet is opened to free the machined ring. At step 530 the program is paused to allow manual removal of the ring, followed by a closing of the collet at step 532 to facilitate installation of a subsequent ring blank before the program ends at step 534. Further finishing of the ring will be accomplished as previously described.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

What is claimed is:

1. A integral ring which is comprised of at least 35 weight percent of a precious metal selected from the group consisting of silver and gold, wherein said ring has a porosity of less than 0.1 percent, a Vickers pyramidal hardness of at least about 120, and a tensile strength at least about 60,000 pounds per square inch, and wherein:

(a) said ring has an inner surface, and outer surface, an inner diameter of from about 0.55 to about 0.93 inches, and outer diameter of from about 0.61 to about 1.09 inches, and a thickness of from about 0.03 to about 0.08 inches;

(b) said ring has a circumference of from about 1.7 to about 3.5 inches, (c) disposed about and extending around the entire outer surface of said ring is a first annular groove and a second, spaced apart annular groove, and at least 10 adjoining recessed areas disposed between and communicating with said first annular groove and said second annular groove, wherein each of said first annular groove and said second annular groove has a width of from about 0.01 to about 0.02 inches and a depth of from about 0.008 to about 0.018 inches, and each of said recessed areas has a depth of from about 0.02 to about 0.03 inches, and (d) disposed between said adjoining recessed areas are at least about 10 raised inidicia extending upwardly from said recessed area.

2. The ring as recited in claim 1, wherein each of said raised indicia is defined by at least four arcuate surfaces.

3. The ring as recited in claim 1, wherein said ring has a Vickers pyramidal hardness of at least about 130.

4. The ring as recited in claim 1, wherein said ring has a tensile strength of at least about 75,000 pounds per square inch.

5. The ring as recited in claim 1, wherein said ring consists essentially of silver.

6. The ring as recited in claim 1, wherein said ring consists essentially of silver alloy.

7. The ring as recited in claim 1, wherein said ring consists essentially of gold.

* * * * *